US005188222A

United States Patent [19]

Pierce

[11] Patent Number: 5,188,222

[45] Date of Patent: Feb. 23, 1993

[54] ANTI-THEFT DISPLAY PACKAGE FOR ANIMATED TALKING TIME PIECES

[75] Inventor: Harold D. Pierce, Westlake Village, Calif.

[73] Assignee: Sounds Fun, Inc., Northridge, Calif.

[21] Appl. No.: 775,309

[22] Filed: Oct. 11, 1991

[51] Int. Cl.[5] ..... B65D 25/00; B65D 73/00

[52] U.S. Cl. ..... 206/45.34; 206/461; 206/471

[58] Field of Search ..... 206/45.34, 471, 461

[56] References Cited

U.S. PATENT DOCUMENTS 3,533,503 10/1970 Wood et al. ..... 206/45.34
4,091,927 5/1978 Lunsford ..... 206/461
4,925,025 5/1990 Anten et al. ..... 206/45.34

*Primary Examiner*—William I. Price
*Attorney, Agent, or Firm*—Fulwider, Patton, Lee & Utecht

[57] ABSTRACT

The anti-theft display package includes a casing which retains an animatable time piece spaced apart from the transparent covering to allow the animated time piece to move. Access to a switch to cause the time piece to become animated and emit sound to tell time is also incorporated in the packaging apparatus.

9 Claims, 3 Drawing Sheets

ANTI-THEFT DISPLAY PACKAGE FOR ANIMATED TALKING TIME PIECES

BACKGROUND OF THE INVENTION

1. Field of the Invention

This invention relates to packaging for consumer products and more specifically to a display package for animated talking timepieces which includes means to actuate the timepiece and incorporate anti-theft features.

2. Description of Related Art

Display packaging for consumer products is an important part of the merchandizing of such products, particularly when the products incorporate features which are visually attractive to the purchaser. In particular, the timepieces and other items which display unique and attractive design characteristics are advantageously displayed in a way which allows the purchaser to readily see such features and, therefore, be able to choose the features without removing each item from its packaging in order to inspect and assess its attractiveness. Many timepieces, particularly those which are of higher quality level, are displayed outside of any packaging but within secured cases in order to prevent shop lifting and make other attempts at theft difficult. Less expensive timepieces may be displayed in a display package which allows visual inspection of the watch but does not allow for the handling and manipulation of the watch until removed from the package.

Larger and more elaborate timepieces are generally displayed without packaging, although some may be displayed in packages with a clear front to allow visual inspection of the design features. Items displayed in this way typically would include lower priced novelty clocks and alarm clocks of the type that would be placed on a chair or nightstand. If the novelty item which may or may not incorporate a clock has certain prominent features, for example, the bust or body shape of a cartoon character or the like, the packaging may also include means to retain the figure, also allowing the display of the item through transparent parts of the packaging.

The creation of new types of animated talking timepieces has created a challenge which is unmet by packaging concepts presently on the market. Such timepieces incorporate in a single wrist worn or desk top figure a timepiece which both talks and moves the mouth or other appendage in response to a physical actuation of a switch or switches on the timepiece. Thus, it is important that such a timepiece be included in packaging which allows these important features, which include the sound associated with the voice simulation and the actuation of the mouth or other appendage in response to actuation of the switches by the perspective purchaser, to be viewed or observed. Due to the popularity of such items and the ease with which they may be stolen, it is also important that these features be present in a packaging concept which includes means to prevent damage to the watch or timepiece if it is dropped or crushed against other items, and which includes theft deterrent features to prevent, to the extent possible, the theft of the timepiece. The present invention addresses and provides a solution to all of these problems.

SUMMARY OF THE INVENTION

New types of animated talking timepieces have rapidly achieved remarkable popularity and have become the subject of licenses from major cartoon companies. The timepieces take the form of a small figurine of a cartoon character which incorporates the features of the character and includes an animated mouth or other appendage which operates in a life-like manner in response to actuation by switch on the watch and in synchronization with an audio output simulating the voice of the character telling the time displayed on a liquid crystal display incorporated in the watch. Such timepieces may be in the form of a wrist watch or a desk clock, and have been found to be very attractive when these features are displayed to the perspective purchaser. While it is possible that a salesperson could be present to provide a sample for the perspective purchaser to actuate, thereby understand the benefits of the features of the timepiece, the relatively low cost of such timepieces and the means by which they are displayed in consumer product stores, means that it would be highly advantageous if these features could be examined by the perspective purchaser while the product remains in a theft resistant package.

The present invention provides these desirable characteristics by incorporating the timepiece within a transparent casing which retains the timepiece in a way that the moving appendage is spaced apart from the transparent covering and also retained against the mounting surface for the timepiece. Means to actuate the switches which cause the timepiece to animate and emit sound to tell time are also incorporated in the packaging design.

In a preferred embodiment, the package takes the form of two formed pieces of plastic material. The first piece is an essentially flat base and the second a cover with similar outlines and mating to the base. Incorporated into the cover is a molded portion which secures the timepiece from movement within the cover and spaces the cover away from the animated portion of the timepiece. Incorporated within the base is means, including recesses formed within the base, to allow the actuation of the switches on the timepiece to thereby initiate the animated operation of the timepiece. The two halves of the anti-theft display package are bonded together at the inner face by thermal or adhesive means in order to form a single structure once the package has been assembled. The package may include a printed instruction and marketing card of the timepiece and the timepiece is also preferably secured to the base with removable retaining means, such as a twisted wire or the such, so that the watch, through the use of this retaining means and the retaining means molded into the cover, is prevented from movement within the package until the package is disassembled.

In a second preferred embodiment, a desk top clock or the like may be displayed within a transparent upper portion, the clock resting on a lower portion and actuation means may be incorporated in the upper portion to allow for the selective actuation of the switch means, thereby causing the animation features and the sound features of the watch to be displayed to the perspective purchaser. Such actuation means may include, depending upon the complexity of the actuation desired for the particular timepiece being displayed, a pivoted lever assembly with the portion to be actuated by the perspective purchaser extending from the package and the internal portion of the actuation lever arranged so that actuation of the exterior portion causes the interior portion to operate upon the switch means incorporated in the clock.

From the above, it may be seen that the present invention provides an effective, economical and attractive means to display animated talking timepieces and the like. Other features and benefits of the invention will become apparent from the following detailed description which illustrates, by way of example, the features of the invention.

DETAILED DESCRIPTION OF THE PREFERRED EMBODIMENTS

The present invention provides for a reliable and theft-proof method of displaying a three-dimensional watch or other timepiece of the like in a way which allows for the actuation of animation features and the observation of the animation, while also providing means of securing the timepiece for movement within the packaging apparatus.

Figure 1:
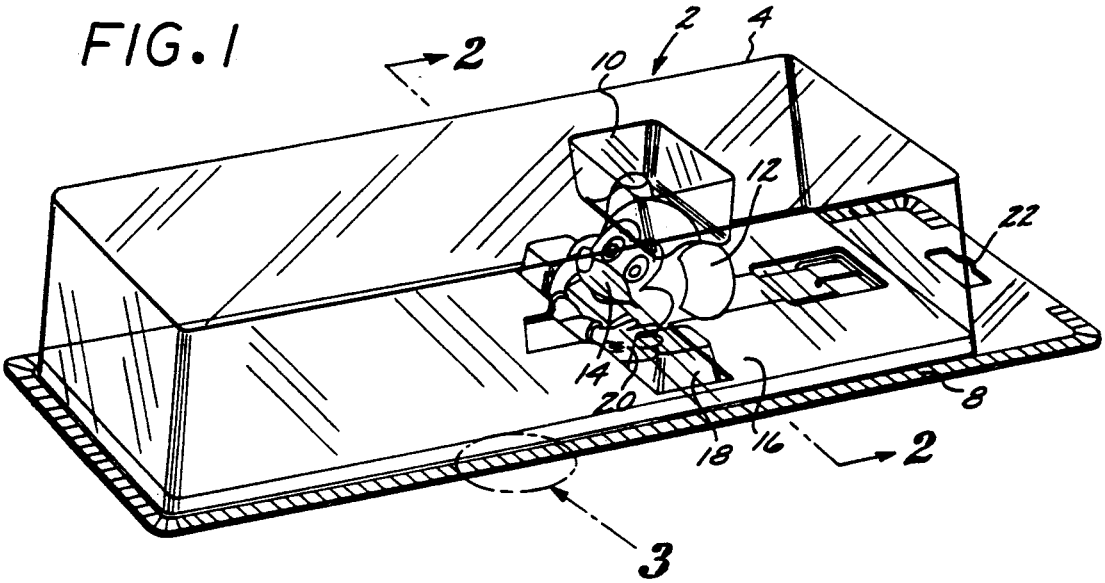
FIG. 1 is an overall perspective view of the packaging of the present invention.

Referring to FIG. 1, the package of the present invention 2 includes an upper cover 4 and lower base 6 which are fastened together by bonding means at an outside beaded edge 8. The cover of the transparent cover 4 includes a recessed portion 10 which serves to hold the cover away from the animated timepiece 12. The cover is formed of a thin, clear plastic material, preferably polyethylene or the like and is selected to be thinner than the base 6. Recess 10 is chosen and sized to prevent the intrusion of the cover on a moving appendage 14 in the timepiece 12. The base also includes an internal card 16 which can have printed material such as instructions and promotional descriptions or the like and which surrounds timepiece 12. The lower panel 6 also includes raised portions 18 sized to allow access to the portions of the figure 12 covering the switch means 20.

Figure 2:
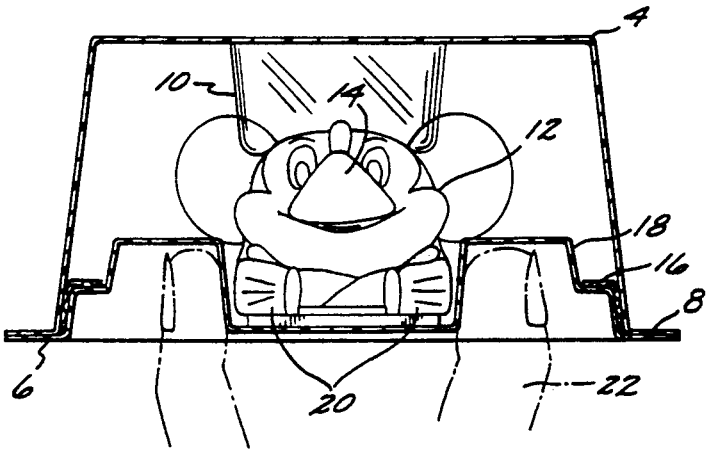
FIG. 2 is an end view of the package of the invention showing the placement of figures to actuate the enclosed timepiece.
Figure 3:
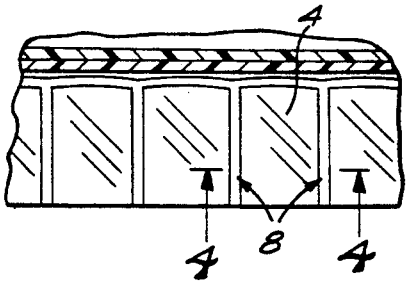
FIG. 3 is a section at 3 of FIG. 1 illustrating the security fastening means of the present invention.
Figure 4:
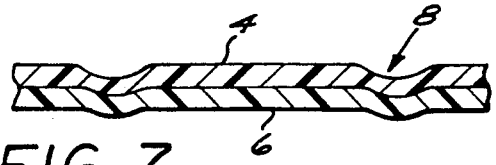
FIG. 4 is a cross-section at 4—4 of FIG. 3.

Referring to FIG. 2 which is a cross-section of FIG. 1 at 2—2, the animated figure 12 is seen to be held not only longitudinally but laterally by recess 10 in cover 4. The moving appendage 14 is thus held away from the cover and is free to move in response to the commands received when switch covers 20 are depressed by fingers 22 inserted into lower recesses 18 and a squeezing motion is imparted to the hands. Cover 4 is bonded to lower portion 6 by means of heat and pressure fastening means or adhesive means at the bead 8. FIG. 3 illustrates the form of the anti-theft beading formed around the edges of the cover and base 4 and 6. In FIG. 4 the beading of the edges at 4—4 is illustrated, showing that in the preferred embodiment pressure and heat may be used to seal the edges and thus prevent the easy removal of the watch from the package.

Figure 5:
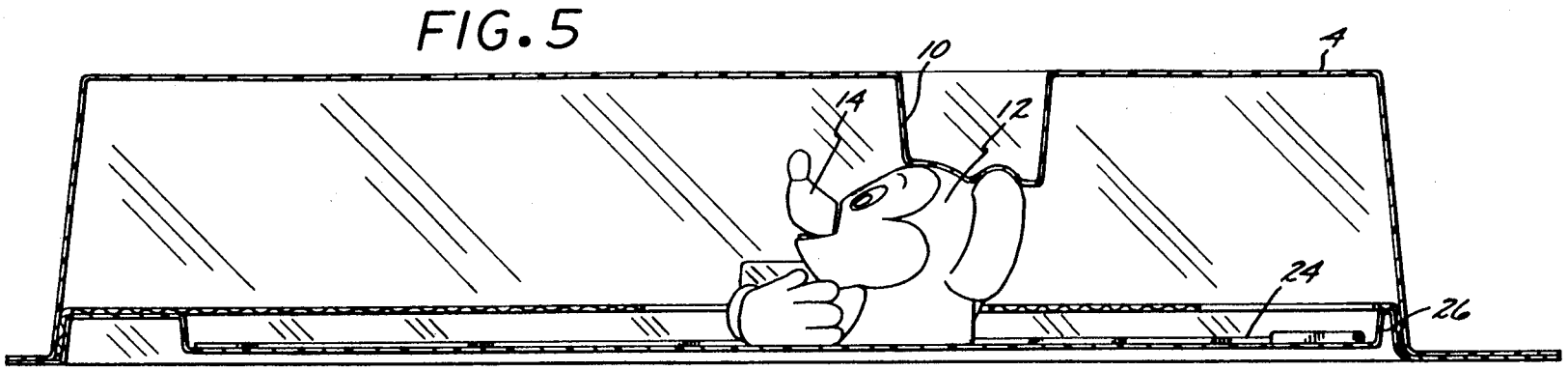
FIG. 5 is a side view of the package of the invention.

Referring again to FIG. 1, the package of the present invention often may be used by itself and suspended from hooks for display on a slot 22 or the like and an important aspect of the security of such a system is contained in the security of the fastening between the upper and lower halves. FIG. 5 is a side view of the packaging system of the present invention illustrating the arrangement of the watch within the package. In this preferred embodiment, the wrist wrap 24 of the watch rests in a recess 26 which is formed longitudinally in the lower portion of the package. Display card 16 then rests in an area above recess 26, assisting in the prevention of the strap from being displaced within the package.

Figure 7:
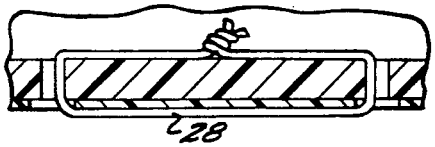
FIG. 7 is a section at 7—7 of FIG. 6.
Figure 6:
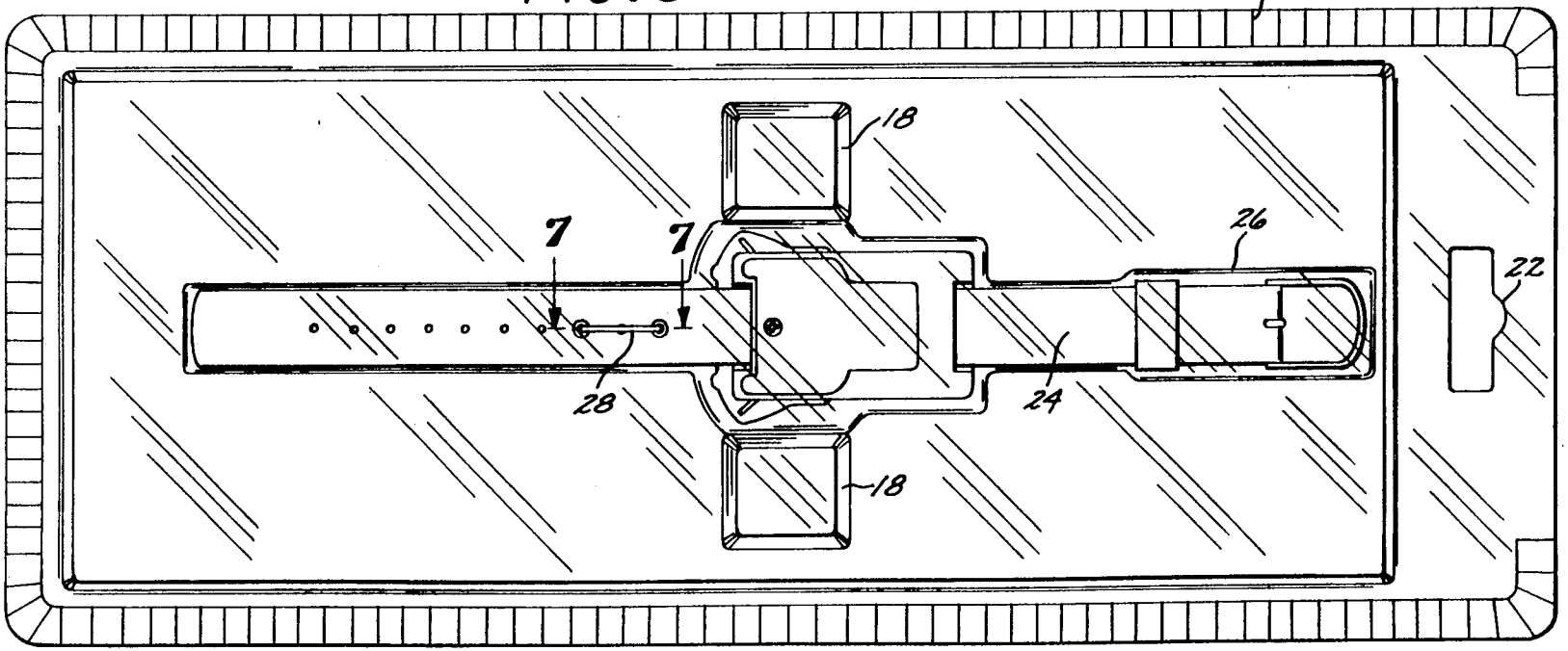
FIG. 6 is a top view of the package of the invention.

Referring to FIG. 6, it may be seen that the package of the present invention includes recess 26 formed in the general outline of the watch and strap, thus providing longitudinal and lateral location of the watch in combination with recesses 10 and 18, which are used to locate and space the watch away from the cover, in addition to allowing access to the animation switches. In order to provide increased security and avoid the possibility that the watch will be displaced from the recess 26, a tie wrap 28 generally illustrated in FIG. 7 is also used to positively locate the watch to the recess in the lower portion 6.

Figure 8:
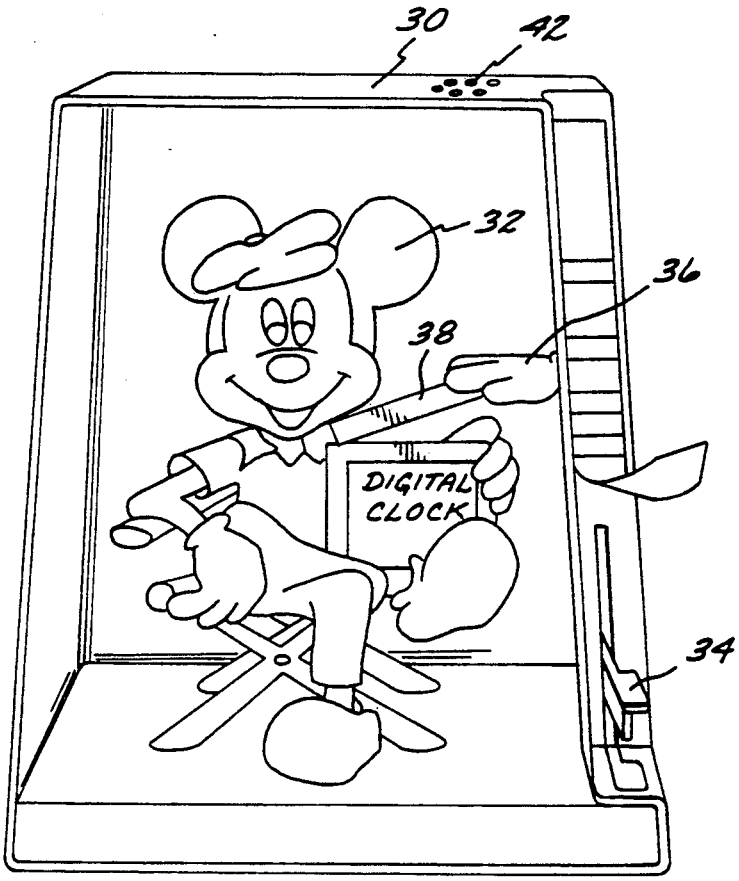
FIG. 8 is a perspective view of a second embodiment of the invention for a free-standing timepiece.
Figure 9:
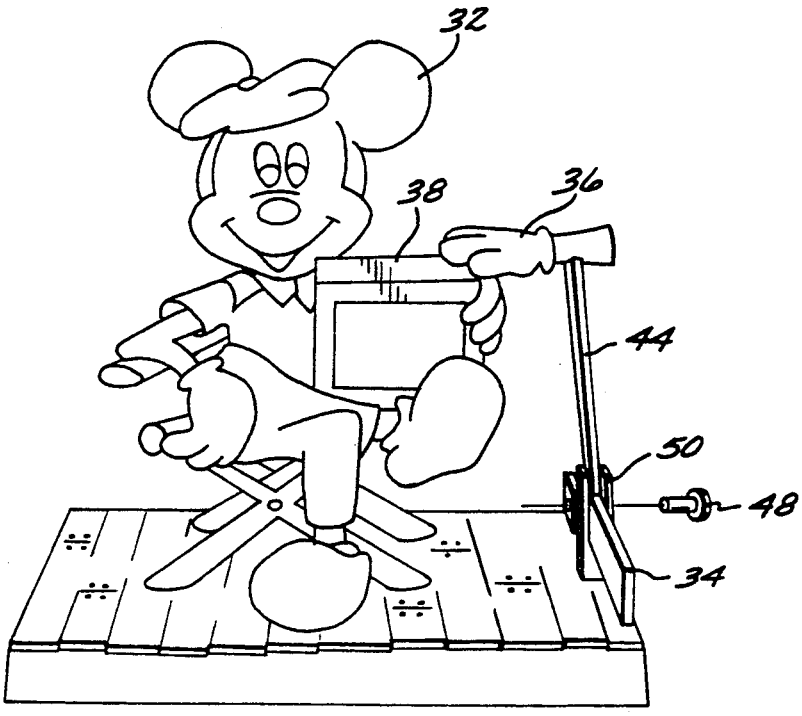
FIG. 9 is a perspective view of the second embodiment of the invention with the cover removed.

In a second preferred embodiment applicable to a free standing timepiece of the time placed on a desk or mantel, FIG. 8 illustrates the form of the invention in which a top cover 30 is formed of clear plastic in order to allow a clear view of the figure 32 within the package 2. A lever 34 is connected to an internal mechanism which moves a remote portion 36 which in turn actuates the switching mechanism 38, thereby causing the clock display 40 to operate and the animation features of figure 32 to be caused to move in response to the switch input. The upper portion 30 also may include perforations 42 for transmitting sound. FIG. 9 illustrates the packaging of the preferred embodiment in which the internal mechanism 44 may be viewed. Internal mechanism 44 includes a lever arm 46 which pivots on pivot pin 48 received in a trunnion 50, thereby causing remote arm 36 to operate switch means 38 in response to pressing on lever 34.

From the above, it will be evident to those skilled in the art that the present invention provides many advantages in a secure and attractive display of an animated timepiece. While particular forms of the invention have been described and illustrated, it is not intended that the invention be limited except as by the appended claims.

We claim:

1. A package and display system for displaying an animatable object having a switch for operating the object, comprising:

an essentially planar molded base, said base including at least one recess to receive the object and to provide access to the switch of the object to be displayed within said package;

a molded transparent cover, including means to restrain and space away said cover from an object to be displayed;

fastening means about the periphery of said cover and said base for securely fastening said cover to said base; and means to fasten an object to be displayed to said base.

2. The display system of claim 1 which further comprises means molded into said base operative to restrain said object to be displayed laterally and longitudinally within said base.

3. The display system of claim 1 which further comprises adhesive bonding means to secure said cover to said base.

4. The display system of claim 1 wherein said bonding means further comprises heat and pressure bonding means on the periphery of said cover and said base.

5. The apparatus of claim 1 further comprising printed display means surrounding said object to be displayed.

6. A display apparatus for displaying an animated watch or the like which comprises:

a base, including recesses within said base to receive an animated object to be displayed;

inwardly facing recesses in said base to allow access to a switch to operate said object's animation;

means to secure said object being displayed to said base;

an essentially transparent cover, said cover sized to mate with said base at said base periphery, said cover further comprising means to retain said animated object to be displayed between said base and said cover, said restraining means further comprising means to space said cover away from the animated feature of said object to be displayed; and bonding means bonding said cover and said base at their mating surfaces.

7. The apparatus of claim 6 which further comprises printed material overlying said base and surrounding said object to be displayed.

8. The apparatus of claim 6 which further comprises fastening means to restrain said object to be displayed against said base.

9. The apparatus of claim 6 further comprising heat and pressure bonding means to bond said cover to said base at their peripheries.

* * * * *